US006580338B1

(12) United States Patent
Tsukamoto et al.

(10) Patent No.: US 6,580,338 B1
(45) Date of Patent: Jun. 17, 2003

(54) DIELECTRIC FILTER, DIELECTRIC DUPLEXER, COMMUNICATION APPARATUS, AND METHOD OF DESIGNING DIELECTRIC RESONATOR APPARATUS

(75) Inventors: Hideki Tsukamoto, Ishikawa-ken (JP); Katsuhito Kuroda, Matto (JP); Jinsei Ishihara, Kanazawa (JP); Hideyuki Kato, Ishikawa-ken (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 0 days.

(21) Appl. No.: 09/616,281

(22) Filed: Jul. 14, 2000

(30) Foreign Application Priority Data

Jul. 15, 1999 (JP) ..... 11-201504

(51) Int. Cl.[7] ..... H01P 1/20
(52) U.S. Cl. ..... 333/134; 333/206
(58) Field of Search ..... 333/134, 202, 333/206, 207, 126, 222, 223

(56) References Cited

U.S. PATENT DOCUMENTS 5,250,916 A * 10/1993 Zakman ..... 333/206
5,488,335 A * 1/1996 Agahi-Kesheh et al. .... 333/206
5,612,654 A * 3/1997 Tsujiguchi et al. ..... 333/202
5,675,301 A * 10/1997 Nappa et al. ..... 333/202
5,712,648 A * 1/1998 Tsujiguchi ..... 343/909
5,742,214 A * 4/1998 Toda et al. ..... 333/202
5,886,986 A 3/1999 Lee et al. ..... 370/276
5,905,420 A * 5/1999 Tsujiguchi et al. ..... 333/206
6,087,909 A * 7/2000 Toda et al. ..... 333/134

FOREIGN PATENT DOCUMENTS

DE 29723526 11/1998
EP 0840390 5/1998
JP 10-308604 A * 11/1998 ..... H01P/1/205

* cited by examiner

*Primary Examiner*—Robert Pascal
*Assistant Examiner*—Dean Takaoka
(74) *Attorney, Agent, or Firm*—Dickstein, Shapiro, Morin & Oshinsky, L.L.P.

(57) ABSTRACT

A dielectric filter, a dielectric duplexer, a communication apparatus are capable of arbitrarily determining the coupling degree of an external coupling without changing the intensity between resonators and miniaturization. Resonator holes are aligned in a dielectric block with a step structure of a large-diameter portion extending in a thickness direction of a dielectric block and a small-diameter portion smaller than the large-diameter portion, and a predetermined pitch is set between the small-diameter portions of the resonator holes and excitation holes by decentering the central axis of the small-diameter portion from the central axis of the large-diameter portion, thereby deciding the intensity of the external coupling.

14 Claims, 7 Drawing Sheets

DIELECTRIC FILTER, DIELECTRIC DUPLEXER, COMMUNICATION APPARATUS, AND METHOD OF DESIGNING DIELECTRIC RESONATOR APPARATUS

BACKGROUND OF THE INVENTION

1. Field of the Invention

The present invention relates to a dielectric filter and a dielectric duplexer using a dielectric block, a communication apparatus using the same, and a method of designing a dielectric resonator apparatus.

2. Description of the Related Art

There is provided a dielectric filter using a dielectric block which adopts a structure that a plurality of resonator holes are provided for the dielectric block, inner diameters of the resonator holes are made different partly, and the line impedance on an opening end side is different from the line impedance on a short-circuited end side. In particular, according to a dielectric filter as disclosed in Japanese unexamined Patent Application Publication No. 8-250904, sectional forms of portions whose inner diameters of resonator holes are different are non-similar and the central axis of small inner diameter is decentered from the central axis of a large inner diameter. According to a dielectric filter as disclosed in Japanese Unexamined Patent Application Publication No. 10-308604, the sectional form of a large inner diameter of the resonator hole is oval or elliptic and the long diameter direction is inclined to the alignment direction of the resonator hole.

According to the dielectric filters disclosed in Japanese Unexamined Patent Application Publications No. 8-250904 and No. 10-308604, it is possible to largely improve the free degree to design a resonance frequency, a coupling degree, and an attenuation frequency. If forming an input/output electrode, which causes an external coupling through the input/output electrode between the large inner diameter portion and an external part, to the dielectric block, it is also possible to largely improve the free degree of designing the external coupling.

However, in order to arbitrarily decide forms of large and small-diameter portions of the resonator hole and positions therebetween and obtain a desired characteristic of the dielectric filter, this causes a problem that the coupling between the resonators and the external coupling must be set simultaneously, and the designing method becomes a remarkably high level. If inclining the long diameter of the large-diameter portion to the alignment direction of the resonator holes, this also causes a problem that the size of the dielectric block is wholly large.

SUMMARY OF THE INVENTION

To overcome the above described problems, preferred embodiments of the present invention provide a dielectric filter, a dielectric duplexer, a communication apparatus, and a method of designing a dielectric resonator apparatus, capable of arbitrarily deciding the intensity of the external coupling without changing the coupling degree between the resonators and miniaturization.

One preferred embodiment of the present invention provides a dielectric filter, comprising: a dielectric block; a plurality of resonator holes aligned substantially in parallel in the dielectric block; an input/output means in association with the dielectric block; the resonator holes comprising a large-sectional area hole and a small-sectional area hole whose sectional area is smaller than that of the large-sectional area hole, the section of the large-sectional area hole being extended in the directions substantially vertical to an alignment direction and a central axis direction of the resonator holes; and the small-sectional area hole being electro-magnetically coupled to the input/output means.

According to the above described structure and arrangement, it is possible to narrow a pitch between central axes of large-diameter portions of adjacent resonator holes and miniaturize a dielectric filter. It is also possible to determine a coupling degree between resonators and intensity of an external coupling, almost independently, the design is simple, and a dielectric resonator apparatus such as a dielectric filter having a predetermined characteristic is obtained easily.

In the above described dielectric filter, the input/output means may be an excitation hole which is provided in the dielectric block. According to the above described structure and arrangement, an intensity of an external coupling can be decided by a position of a small-diameter portion in a resonator hole and a forming position of an excitation hole, so that the dielectric block formation enables a stable characteristic to be obtained easily.

Or, the input/output means may be an electrode which is disposed on an outer surface of the dielectric block. In this case, an intensity of an external coupling can be decided by a position of a small diameter in a resonator hole and a position of input/output electrodes on an outer surface of a dielectric block, so that the adjustment of a forming position of the input/output electrodes enables a predetermined external coupling intensity to be obtained easily.

Another preferred embodiment of the present invention provides a dielectric duplexer constituted by two sets of above described dielectric filters provided in the dielectric block.

Yet another preferred embodiment of the present invention provides a communication apparatus including the above described dielectric filter or the above described dielectric duplexer.

Yet another preferred embodiment of the present invention provides a method of designing a dielectric resonator apparatus, comprising: aligning a plurality of resonator holes substantially in parallel in a dielectric block, the resonator holes comprising a large-sectional area hole and a small-sectional area hole whose sectional area is smaller than that of the large-sectional area hole, the section of the large-sectional area hole being extended in the directions substantially vertical to an alignment direction and a central axis direction of the resonator holes; and determining an external coupling by a distance between input/output means and the small-sectional area hole by decentering a central axis of the small-sectional area hole from a central axis of said large-sectional area hole.

DESCRIPTION OF THE PREFERRED EMBODIMENTS

Figure 1A:
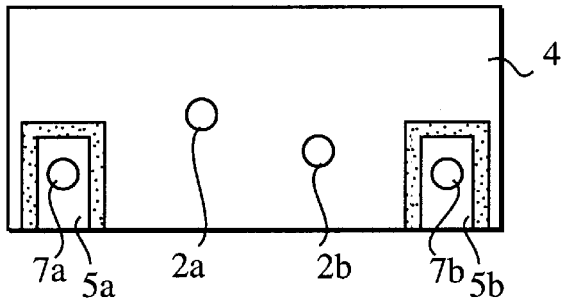
FIGS. 1A, 1B, 1C, and 1C' are diagrams showing a construction of a dielectric filter according to a first embodiment.
Figure 1B:
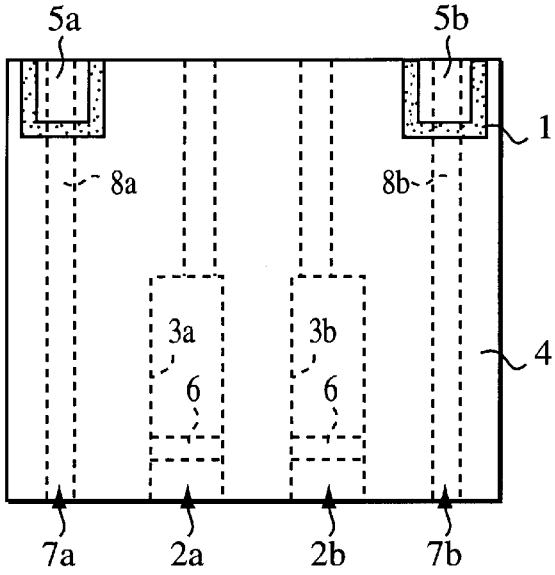
Figure 1C:
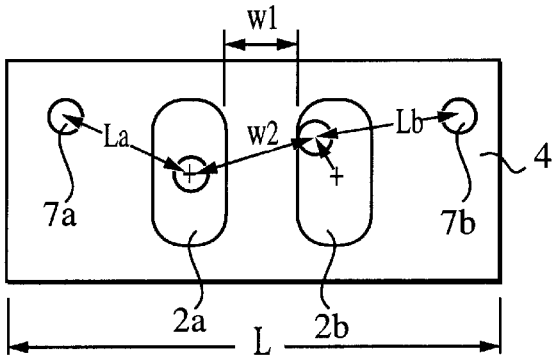
Figure 1C:
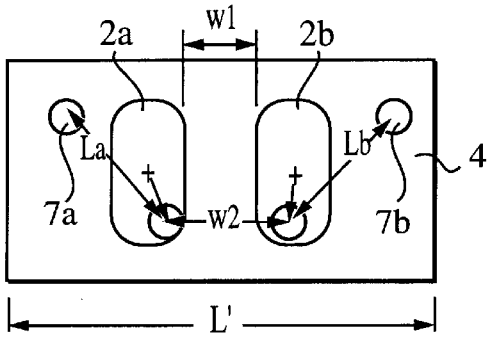

The description turns to a construction of a dielectric filter according to a first embodiment with reference to FIGS. 1A, 1B, 1C, and 1C'.

FIG. 1A is a front view of one dielectric filter which is seen from the axial directions of resonator holes; FIG. 1B is a bottom view of the dielectric filter; FIG. 1C is a rear elevation thereof; and FIG. 1C' is a rear elevation of a dielectric filter having another structure as a comparison. In the figures, reference numeral 1 denotes an almost-rectangular dielectric block, and, therein, resonator holes 2*a* and 2*b* and excitation holes 7*a* and 7*b* are provided. Each of the resonator holes 2*a* and 2*b* have a step structure of a large-diameter portion whose sectional form is oval and a small-diameter portion whose sectional form is circular. The excitation holes 7*a* and 7*b* are straight holes having constant inner diameters. Inner conductors 3*a* and 3*b* are formed onto the inner surfaces of the resonator holes 2*a* and 2*b* and inner conductor non-forming portions 6 are provided near opening surfaces of the large-diameter portions. Inner conductors 8*a* and 8*b* for excitation are formed onto the inner surfaces of the excitation holes 7*a* and 7*b*. An outer conductor 4 is formed onto an outer surface (six-surface) of the dielectric block 1. Input/output electrodes 5*a* and 5*b*, which are continuous from the inner conductors 8*a* and 8*b* for excitation, are separated from the outer conductor 4 by one opening portions of the excitation holes 7*a* and 7*b* and formed.

With the structure, two resonators comprising the resonator holes 2*a* and 2*b* are comb-line coupled by a stray capacity generated at the inner conductor non-forming portion 6. The resonator hole 2*a* and the excitation hole 7*a* are inter-digitally coupled. Similarly, the resonator hole 2*b* and the excitation hole 7*b* are inter-digitally coupled. The coupling degree between the resonator holes 2*a* and 2*b* is decided by a stray capacity which is generated at a pitch w1 between the large-diameter portions, a pitch w2 between the small-diameter portions, and the inner conductor non-forming portion 6 (herein, the pitch between the large-diameter portions is indicated by a distance between the inner conductors and the pitch between the small-diameter portions is indicated by a distance between the central axes). The intensity of the external coupling is determined by pitches between the small-diameter portions of the resonator holes 2*a* and 2*b* and the excitation holes 7*a* and 7*b* (indicated by La and Lb, based on distances between both of the central axes). In other words, the pitches are determined by eccentric quantities of the central axes of the small-diameter portions from the central axes of the large-diameter portions. Then, the pitch w2 between the small-diameter portions of the resonator holes 2*a* and 2*b* is assumed to be constant.

As mentioned above, if decentering the central axis of the small-diameter portion from the central axis of the large-diameter portion, this hardly influences the coupling degree between the resonators. Therefore, the intensity of the external coupling can be decided independently without changing the coupling degree between the resonators.

Incidentally, as shown in the present embodiment, the large-diameter portion of the resonator hole is set to a form which extends to directions vertical to the alignment direction and the axial direction of the resonator hole, that is, the thickness direction of the dielectric block, so that the pitch between the resonator holes can be narrowed and a length L in the resonator hole alignment direction in the dielectric block can be reduced wholly.

FIG. 1C' shows an example wherein the small-diameter portion of the resonator hole is decentered in the direction which is made apart from the excitation hole and, in proportional thereto, the pitches between the excitation holes 7*a* and 7*b* and the resonating holes are narrowed. According to the structure, if narrowing the pitch between the large-diameter portion of the resonator hole and excitation hole, a distance between the small-diameter portion of the resonator hole and the excitation hole can be gained. Therefore, as compared with the length in the resonator hole alignment direction in the dielectric block with that in FIG. 1C, the distance can be decreased from L to L'.

Figure 2A:
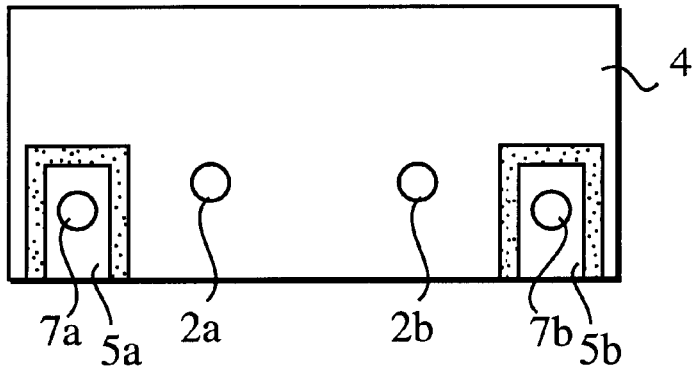
FIGS. 2A, 2B, and 2C are diagrams showing a construction of a dielectric filter according to a second embodiment.
Figure 2B:
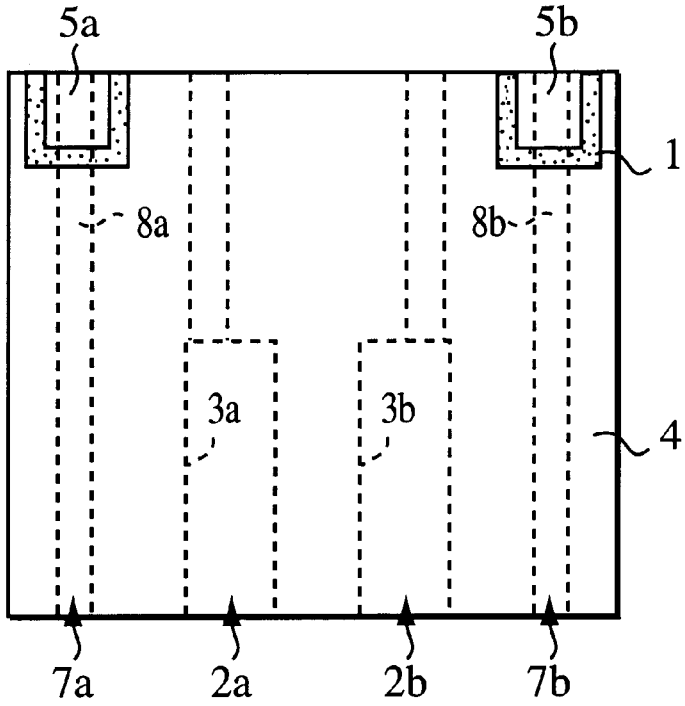
Figure 2C:
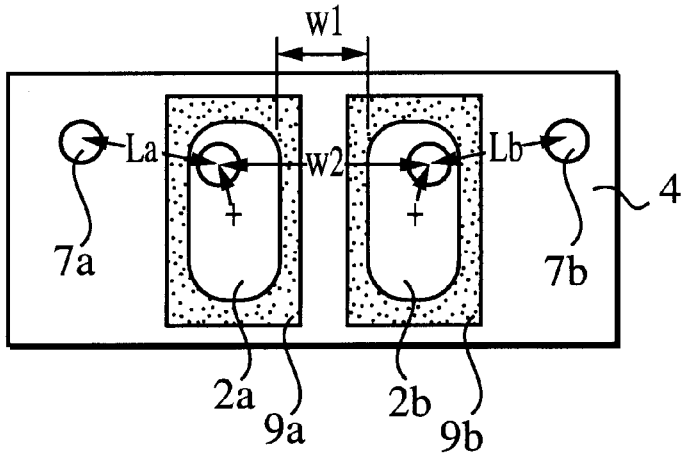

FIGS. 2A, 2B, and 2C show a construction of a dielectric filter according to a second embodiment. Differently from the dielectric filter shown in FIGS. 1A, 1B, 1C, and 1C', the inner conductors 3*a* and 3*b* are formed onto the entire inner-surfaces of the resonator holes 2*a* and 2*b*, and outer conductor non-forming portions 9*a* and 9*b* are provided to the opening portions of the large-diameter portions, thereby generating a stray capacity at those portions. In the thus-obtained structure, the coupling degree between the two resonators comprising the resonator holes 2*a* and 2*b* is also decided by a stray capacity which is generated by the pitch w1 between the large-diameter portions, pitch w2 between the small-diameter portions, and the outer conductor non-forming portions 9*a* and 9*b*, and the intensity of the external coupling is further decided by pitches between the small-diameter portions and the excitation holes 7*a* and 7*b* (indicated by La and Lb, based upon the distances between both of the central axes). In other words, the intensity of the external coupling is decided by eccentric quantities of the central axes of the small-diameter portions from the central axes of the large-diameter portions.

Figure 3A:
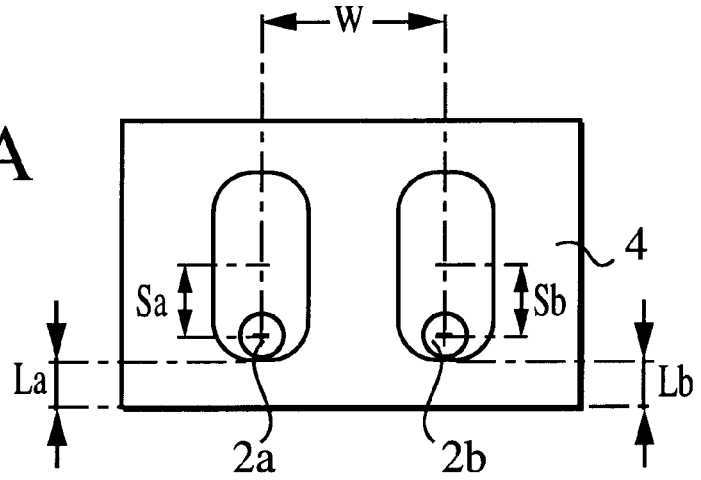
FIGS. 3A, 3B, and 3C are diagrams showing a construction of a dielectric filter according to a third embodiment.
Figure 3B:
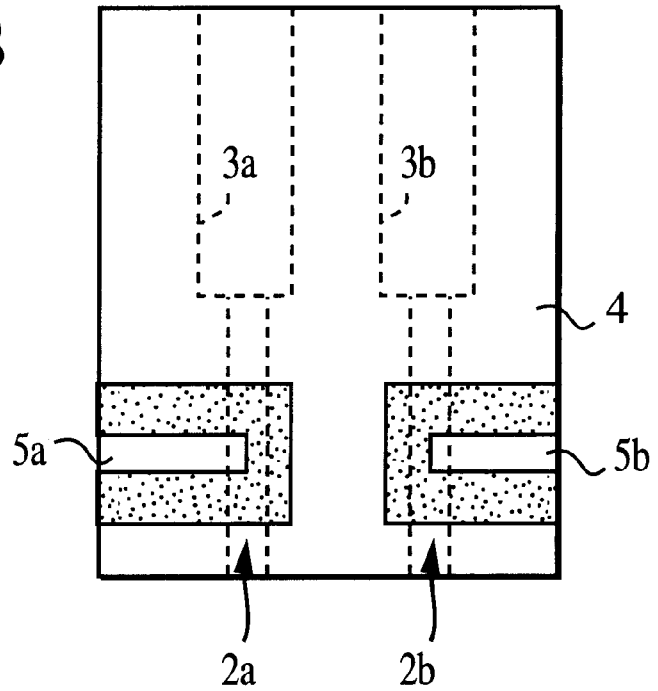
Figure 3C:
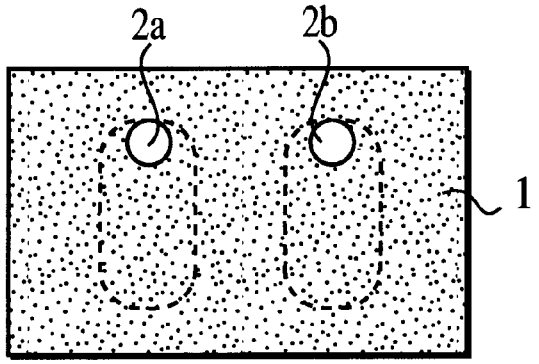

FIGS. 3A, 3B, and 3C are diagrams showing a construction of a dielectric filter according to a third embodiment. The almost-oval dielectric block 1 is therein provided with the resonator holes 2*a* and 2*b* in which inner conductors 3*a* and 3*b* are formed to the inner surfaces of the dielectric block 1. The outer conductor 4 is formed to the outer surface (five-surface) of the dielectric block 1. The opening surfaces on the small-diameter portion sides of the resonator holes 2*a* and 2*b* are opening surfaces having no outer conductor. The input/output electrodes 5*a* and 5*b* are formed near the opening surfaces by separating them from the outer conductor 4.

The resonator hole has the step structure wherein a line impedance on the opening end side is different from that on the short-circuited end side, so that a difference between resonating frequencies of an even mode and an odd mode is caused and the resonators are coupled. If setting the inner diameter of the large-diameter portion to be constant, the coupling degree of the two resonators comprising the resonator holes 2*a* and 2*b* is determined by a pitch (indicated by w, based upon a distance between the both central axes) between the large-diameter portions of the resonator holes 2*a* and 2*b* mainly. The external coupling degree is determined by the pitches La and Lb between the central axes of the small-diameter portions and input/output electrodes 5*a* and 5*b*. In other words, the external coupling degree is decided by eccentric quantities Sa and Sb of the central axes of the small-diameter portions from the central axes of the large-diameter portions.

Figure 4A:
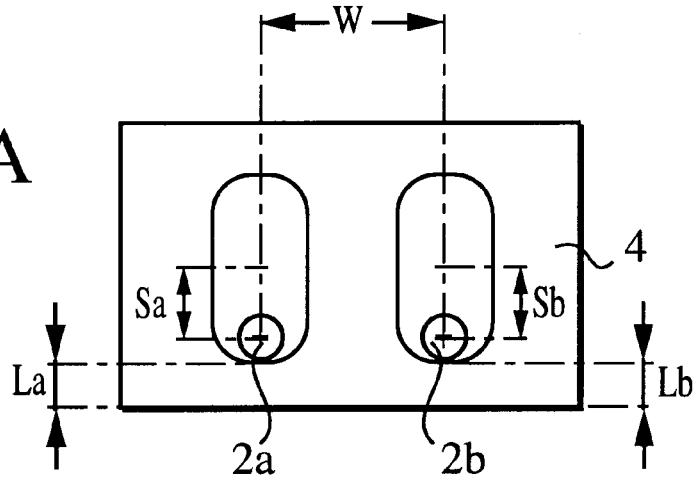
FIGS. 4A, 4B, and 4C are diagrams showing a construction of a dielectric filter according to a forth embodiment.
Figure 4B:
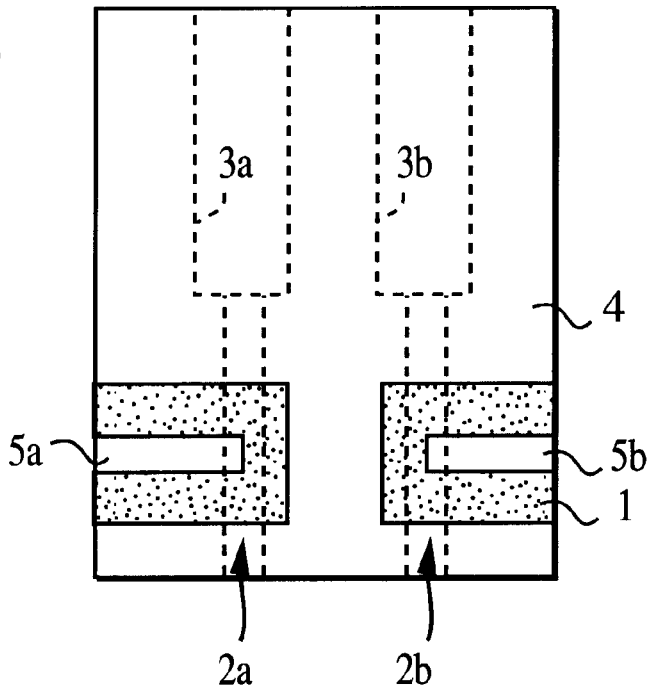
Figure 4C:
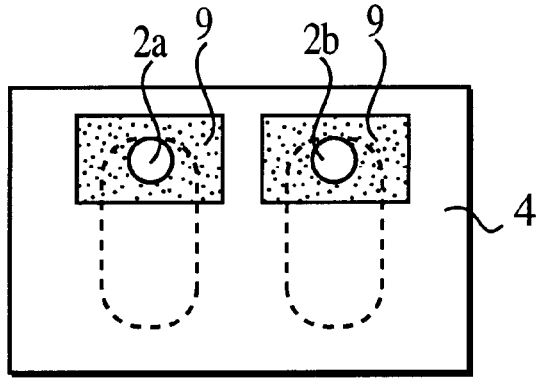

FIGS. 4A, 4B, and 4C are diagrams showing a construction of a dielectric filter according to a forth embodiment. Differently from the structure of the dielectric filter shown in FIGS. 3A, 3B, and 3C, the outer conductor non-forming portion 9 is provided to the opening portions on the small-diameter portions of the resonator holes 2*a* and 2*b*, and the thus-constructed opening portions are set to opening ends. According to the structure, the coupling degree between the resonators is decided by dielectric coupling due to the step structure of the resonator holes 2*a* and 2*b* and dielectric coupling due to the stray capacity generated at the outer conductor non-forming portion 9. Similarly to the case in FIGS. 3A, 3B, and 3C, the external coupling is decided by the pitches La and Lb between the central axes of the small-diameter portions and the input/output electrodes 5*a* and 5*b*, that is, the eccentric quantities Sa and Sb of the central axes of the small-diameter portions from the central axes of the large-diameter portions.

Figure 5A:
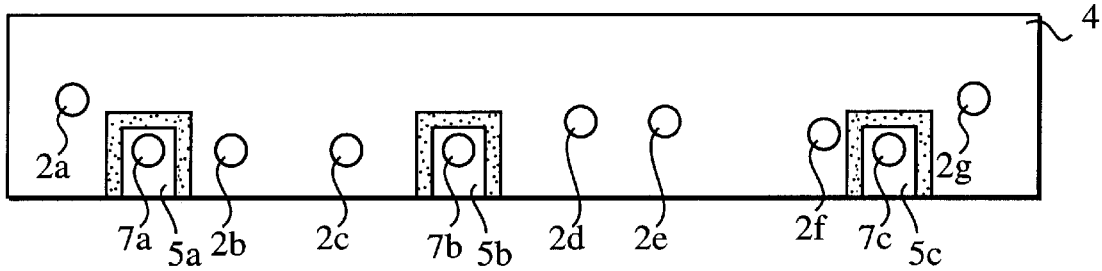
FIGS. 5A, 5B, and 5C are diagrams showing a construction of a dielectric duplexer according to a fifth embodiment.
Figure 5B:
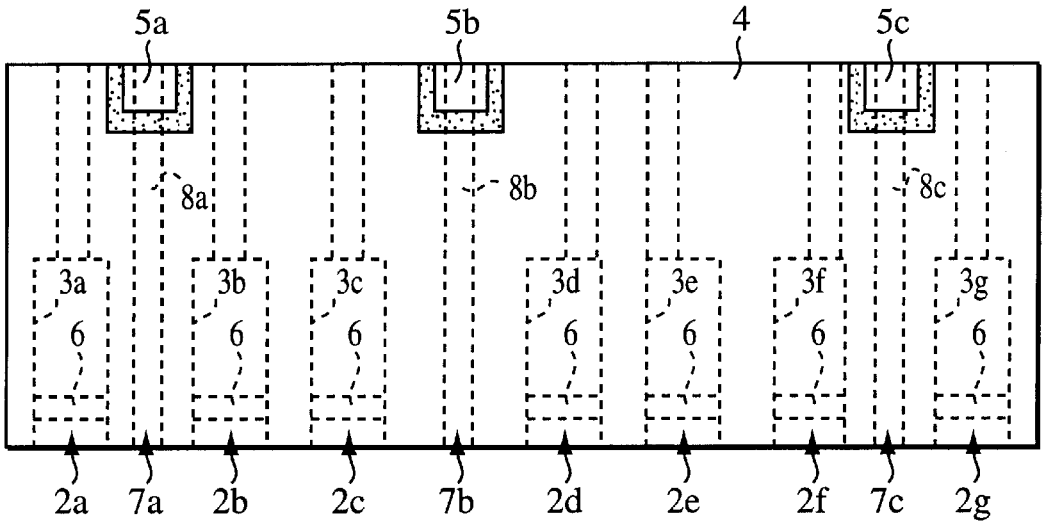
Figure 5C:
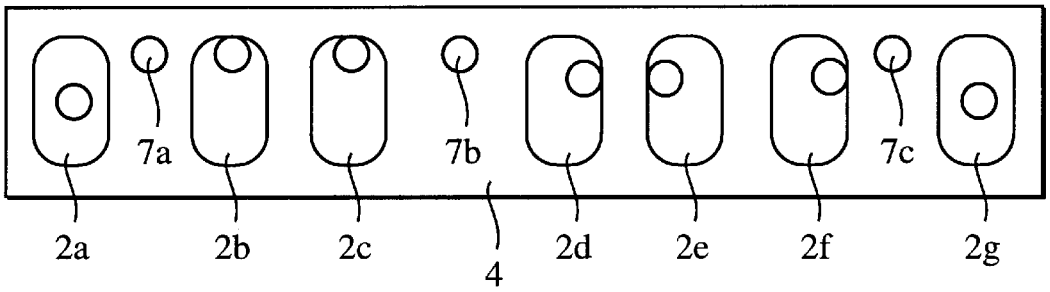

The next description turns to an example of a dielectric duplexer according to a fifth embodiment with reference to FIGS. 5A, 5B, and 5C.

As shown in the figures, resonator holes 2*a* to 2*g* and excitation holes 7*a* and 7c are provided in the dielectric block which is almost rectangular. The inner surfaces of the resonator holes 2*a* to 2*g* are provided with inner conductors 3*a* to 3*g* whose vicinities of one opening portions are set to the inner conductor non-forming portion 6. Inner conductors 8*a* to 8*c* for excitation are wholly formed to the inner surfaces of the excitation holes 7*a* to 7*c*. The resonator holes 2*a* to 2*g* have step holes wherein the opening end side is the large-diameter portion and the short-circuited side is the small-diameter portion, respectively. The outer conductor 4 is formed to the outer surface (six-surface) of the dielectric block, and the input/output electrodes 5*a* to 5*c*, which are continuous from inner conductors 8*a* to 8*c* for excitation, are separated from the outer conductor 4 and formed within a range the short-circuited surfaces of the resonator holes to the side surfaces.

Two resonators comprising the resonator holes 2*b* and 2*c* are comb-line coupled by a stray capacity generated at the inner conductor non-forming portion 6. The resonator comprising the resonator hole 2*b* and the excitation hole 7*a* are inter-digitally coupled. Similarly, the resonator comprising the resonator hole 2*c* and the excitation hole 7*b* are inter-digitally coupled. The two resonators comprising the resonator holes 2*b* and 2*c* function as band pass filters. The resonator comprising the resonator hole 2*a* is inter-digitally coupled to the excitation hole 7*a*, thereby functioning as a trap filter.

Three resonators comprising resonator holes 2*d* to 2*f* are comb-line coupled by a stray capacity generated at the inner conductor non-forming portion 6, and the resonator comprising the resonator hole 2*d* is inter-digitally coupled to the excitation hole 7*b*. Similarly, the resonator comprising the resonator hole 2*f* is inter-digitally coupled to the excitation hole 7*c*. The three resonators comprising the resonator holes 2*d* to 2*f* function as band pass filters. The resonator comprising the resonator hole 2*g* is inter-digitally coupled to the excitation hole 7*c*, thereby functioning as a trap filter.

Passing bands of the band pass filters comprising the resonator holes 2*b* and 2*c* are determined to a transmitting frequency band. An attenuation frequency of the trap filter comprising the resonator hole 2*a* is determined to a frequency between a transmitting frequency band and a receiving frequency band. Passing bands of the band pass filters comprising the resonator holes 2*d* to 2*f* are determined to a receiving frequency band. An attenuation frequency of the trap filter based on the resonator hole 2*g* is determined to a frequency between a receiving frequency band and a transmitting frequency band. Thus, it is capable of using the dielectric duplexer as an antenna multicoupler that the input/output electrodes 5*a*, 5*b*, and 5*c* are set to a transmitting signal input terminal (Tx), an antenna terminal (ANT), and a receiving signal output terminal (Rx).

In the dielectric duplexer, the coupling degree between the resonators comprising the resonator holes 2*b* and 2*c* is determined by a pitch between the large-diameter portions mainly, and the intensity of the external coupling between the resonator comprising the resonator hole 2*b* and the excitation hole 7*a* is determined by a pitch between the small-diameter portion of the resonator hole 2*b* and the excitation hole 7*a*. Similarly, the external coupling intensity between the resonator comprising the resonator hole 2*c* and the excitation hole 7*b* is also determined by the pitch between the small-diameter portion of the resonator hole 2*c* and the excitation hole 7*b*. The intensity of the external coupling between the resonator comprising the resonator hole 2*a* and the excitation hole 7*a* is further determined by the pitch between the small-diameter portion of the resonator hole 2*a* and the excitation hole 7*a*. The coupling degree among the resonators 2*d* to 2*f* is determined by the pitches among the large-diameter portions mainly. The intensity of the external coupling between the resonator comprising the resonator hole 2*d* and the excitation hole 7*b* is determined by the pitch between the small-diameter portion of the resonator hole 2*d* and the excitation hole 7*b*. Likewise, the intensity of the external coupling between the resonator comprising the resonator hole 2*f* and the excitation hole 7*c* is determined by the pitch between the small-diameter portion of the resonator hole 2*f* and the excitation hole 7*c*. The intensity of the external coupling between the resonator comprising the resonator hole 2*g* and the excitation hole 7*c* is also decided by the pitch between the small-diameter portion of the resonator hole 2*g* and the excitation hole 7*c*.

Figure 6A:
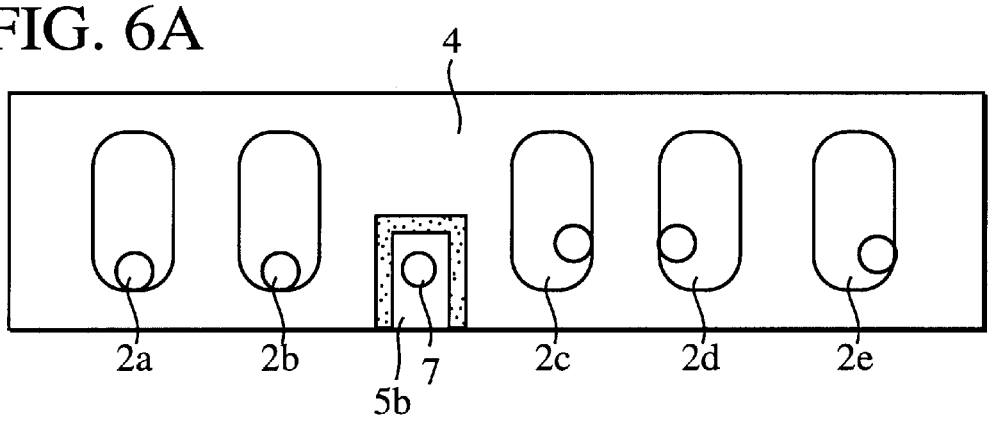
FIGS. 6A, 6B, and 6C are diagrams showing a construction of a dielectric duplexer according to a sixth embodiment.
Figure 6B:
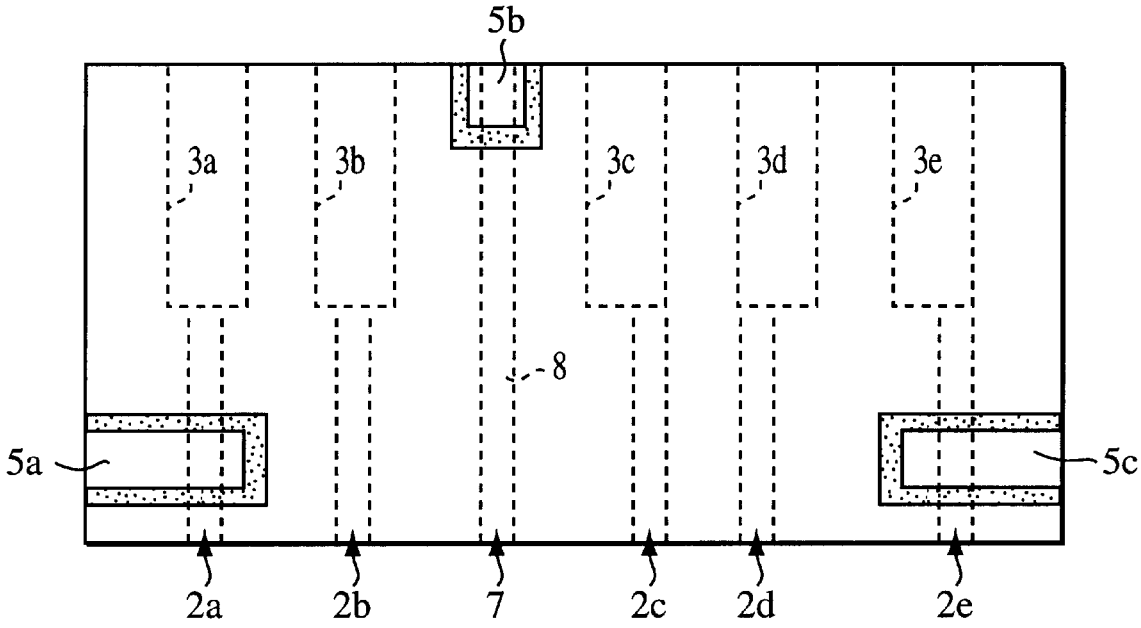
Figure 6C:
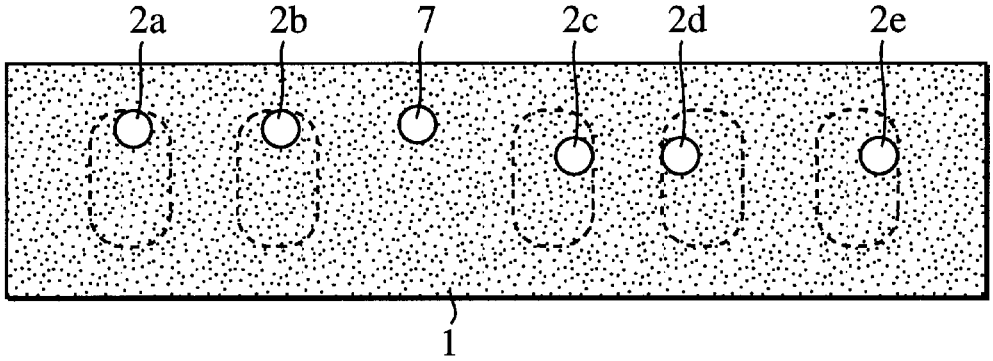

FIGS. 6A, 6B, and 6C are diagrams showing a construction of a dielectric duplexer according to a sixth embodiment.

According to examples in FIGS. 6A to 6C, resonator holes 2*a* to 2*e* and an excitation hole 7 are provided in the dielectric block 1 which is almost rectangular. Inner conductors 3*a* to 3*e* are formed in a manner such that the vicinities of one opening portions of the inner conductors 3*a* to 3*e* are opening ends onto the inner surfaces of the resonator holes 2*a* to 2*e*. An inner conductor 8 for excitation is formed to the entire inner-surface of the excitation hole 7. Each of the resonator holes 2*a* to 2*e* is structured by a step hole in a manner such that a small-diameter portion is provided for the opening end side and a large-diameter portion is provided for the short-circuited end side, respectively. The outer conductor 4 is formed to an outer surface (five-surface) of the dielectric block, and the input/output electrode 5*b*, which is continuous from the inner conductor 8 for excitation, is separated from the outer conductor 4 and formed from the short-circuited surface to the side surface of each resonator hole. Further, input/output electrodes 5*a* and 5*c* are separated from the outer conductor and formed on the side surface of the dielectric portion.

Two resonators comprising the resonator holes 2*a* and 2*b* are coupled by the step hole, and function as a band pass filter. The resonator comprising the resonator hole 2*b* is inter-digitally coupled to the excitation hole 7. Likewise, three resonators comprising the resonator holes 2*c* to 2*e* are coupled by the step hole, and function as a band pass filter.

The resonator comprising the resonator hole 2*c* is interdigitally coupled to the excitation hole 7. Furthermore, the opening end vicinities of the resonators comprising the resonator holes 2*a* and 2*e* are coupled to the input/output electrodes 5*a* and 5*c* by electrostatic capacities, respectively.

Passing bands of the band pass filters comprising the resonator holes 2*a* and 2*b* are set to a transmitting frequency band. Passing bands of the band pass filters comprising the resonator holes 2*c* to 2*e* are set to a receiving frequency band. Thus, it is capable of using the dielectric duplexer as an antenna multicoupler that the input/output electrodes 5*a*, 5*b*, and 5*c* are set to a transmitting signal input terminal (Tx), an antenna terminal (ANT), and a receiving signal output terminal (Rx).

In the dielectric duplexer, the coupling degree between the resonators comprising the resonator holes 2*a* and 2*b* are determined by a pitch between the large-diameter portions mainly, and the coupling degree among the resonators comprising the resonator holes 2*c* to 2*e* is determined by a pitch among the large-diameter portions mainly. The external coupling intensities between the resonators comprising the resonator holes 2*a* and 2*e* and the input/output electrodes 5*a* and 5*c* are determined by pitches between the small-diameter portions of the resonator holes 2*a* and 2*e* and the forming surfaces of the input/output electrodes 5*a* and 5*c*.

Figure 7:
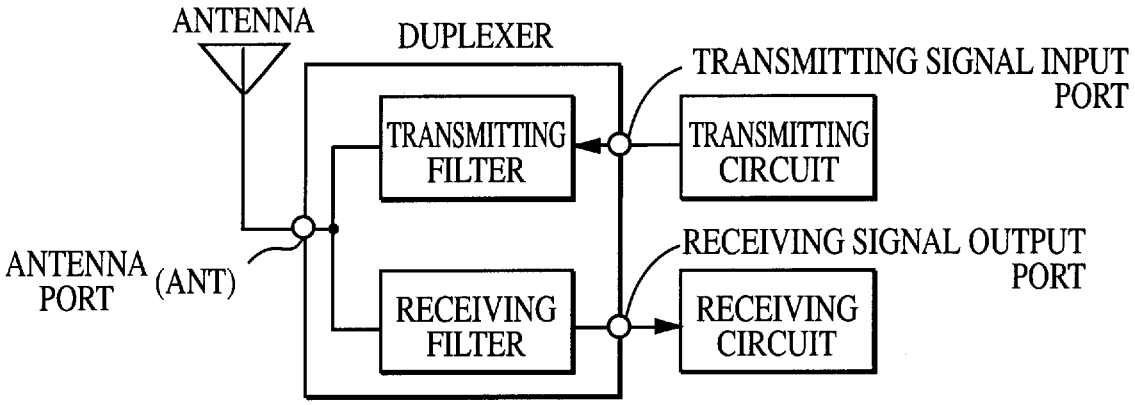
FIG. 7 is a diagram showing a construction of a communication apparatus according to a seventh embodiment.

FIG. 7 is a diagram showing a construction of a communication apparatus according to a seventh embodiment. Herein, a duplexer comprises a transmitting filter and a receiving filter. As the duplexer, the dielectric duplexer with the structure shown in FIGS. 5A to 5C or FIGS. 6A to 6C is utilized. A transmitting circuit is connected to a transmitting signal input port of the duplexer, a receiving circuit is connected to a receiving signal output port thereof, and an antenna is further connected to an antenna port thereof. An output portion in the transmitting circuit and an input port in the receiving circuit have band pass filters, respectively. As the filters, the dielectric filters with the structure shown in FIGS. 1 to 4 are utilized.

As mentioned above, by utilizing the dielectric filter or dielectric duplexer having a small size and a predetermined characteristic, it is able to obtain a communication apparatus which is, wholly small and lightweight.

While the invention has been particularly shown and described with reference to preferred embodiments thereof, it will be understood by those skilled in the art that the forgoing and other changes in form and details may be made therein without departing from the spirit of the invention.

What is claimed is:

1. A filter, comprising:

a dielectric block;

first and second adjacent plated resonator holes located in the dielectric block, each of the plated resonator holes having a stepped configuration with a large sectional area portion corresponding to an open circuit end of the plated resonator hole and a small sectional area portion corresponding to a closed circuit end of the plated resonator hole, a central axes of the large sectional area portion being offset from a central axis of the small sectional area portion;

the large sectional area portions of the first and second resonator holes being elongated in a direction perpendicular to an alignment direction defined by an imaginary line extending between the central axes of the two large sectional area portions;

an input/output means located in the area of the small cross sectional area portion of the first resonator hole in such a manner that the coupling degree between the first plated resonator hole and the input/output means is determined primarily by the distance between the small cross sectional area portion of the first plated resonator hole and the input/output means whereby the coupling between the first and second plated resonator holes is determined substantially independently of the coupling between the first plated resonator holes and the input/output means.

2. The filter of claim 1, wherein the input/output means is an excitation hole provided in the dielectric block adjacent the first resonator hole.

3. The filter of claim 1, wherein the input/output means is an input/output electrode located on an external surface of the dielectric block.

4. The filter of claim 1, wherein the dielectric block is a rectangular parallelepiped.

5. The filter of claim 1, further including an outer electrode located on at least one surface of the dielectric block.

6. The filter of claim 1, wherein each of the resonator holes extend from a first to a second opposed surface of the dielectric block, the large sectional area portions of the resonator holes extending to the first surface, the small area portions of the resonator holes extending to the second surface.

7. The filter of claim 1, wherein the large sectional area portions have an oval cross section.

8. The filter of claim 1, wherein the open ends of the plated resonator holes are defined by unplated areas of the plated resonator holes.

9. The filter of claim 1, wherein the central axis of the small sectional area portions of the resonator holes are offset from the central axis of their associated large sectional area portions along a direction parallel to the alignment direction.

10. The filter of claim 1, wherein the central axis of the small sectional area portions of the resonator holes are offset from the central axis of their associated large sectional area portions along a direction perpendicular to the alignment direction.

11. A method of designing a dielectric resonator apparatus, comprising:

selecting the location, spacing and shape of a plurality of plated resonator holes in a dielectric block, at least two adjacent resonator holes having a stepped configuration with a large sectional area portion corresponding to an open circuit end of the plated resonator hole and a small sectional area portion corresponding to a closed circuit end of the plated resonator hole, a central axes of the large sectional area portion being offset from a central axis of the small sectional area portion, the spacing and shape of the large and small sectioned area portions being selected as a function of the desired electromagnetic coupling between the first and second resonator holes;

selecting the location, spacing and shape of an input/output means with respect to one of the two plated resonator holes as a function of the desired electromagnetic coupling between the first plated resonator hole and the input/output means independently of the spacing and shape of the large sectional area portions of the two adjacent plated resonator holes.

12. The dielectric duplexer of claim 11, wherein both of the transmitter and receiver filters are formed in a single dielectric block and comprise:

first and second adjacent plated resonator holes located in the dielectric block, each of the plated resonator holes having a stepped configuration with a large sectional area portion corresponding to an open circuit end of the plated resonator hole and a small sectional area portion corresponding to a closed circuit end of the plated resonator hole, a central axes of the large sectional area portion being offset from a central axis of the small sectional area portion;

the large sectional area portions of the first and second resonator holes being elongated in a direction perpendicular to an alignment direction defined by an imaginary line extending between the central axes of the two large sectional area portions;

an input/output means located in the area of the small cross sectional area portion of the first plated resonator hole in such a manner that the coupling degree between the first plated resonator hole and the input/output means is determined primarily by the distance between the small cross sectional area portion of the first plated resonator hole and the input/output means whereby the coupling between the first and second plated resonator holes is determined substantially independently of the coupling between the first plated resonator hole and the input/output means.

13. A dielectric duplexer comprising a transmitter filter and a receiver filter, at least one of the transmitter and receiver filters comprises:

a dielectric block;

first and second adjacent plated resonator holes located in the dielectric block, each of the plated resonator holes having a stepped configuration with a large sectional area portion corresponding to an open circuit end of the plated resonator hole and a small sectional area portion corresponding to a closed circuit end of the plated resonator hole, a central axes of the large sectional area portion being offset from a central axis of the small sectional area portion;

the large sectional area portions of the first and second resonator holes being elongated in a direction perpendicular to an alignment direction defined by an imaginary line extending between the central axes of the two large sectional area portions;

an input/output means located in the area of the small cross sectional area portion of the first resonator hole in such a manner that the coupling degree between the first plated resonator hole and the input/output means is determined primarily by the distance between the small cross sectional area portion of the first plated resonator hole and the input/output means whereby the coupling between the first and second plated resonator holes is determined substantially independently of the coupling between the first plated resonator hole and the input/output means.

14. A method of designing a dielectric resonator apparatus, comprising:

aligning first and second resonator holes in a dielectric block substantially in parallel with each other in a length direction of the dielectric block and adjacent to each other in a width direction of the dielectric block, the first and second resonator holes each including a first portion and a second portion, respectively, the first portion having a first sectional area larger than a second sectional area of the second portion, the first sectional area extending substantially in a thickness direction of the dielectric block further than in a width direction of the dielectric block;

connecting first and second input/output means to the first and second resonator holes, respectively;

determining resonator coupling between the first and second resonator holes by setting a first distance between the respective first portions of the first and second resonator holes, and setting a second distance between the respective second portions of the first and second resonator holes; and determining an external coupling by changing at least one of a third distance between the second portion of the first resonator hole and the first input/output means and a fourth distance between the second portion of the second resonator hole and the second input/output means, while keeping the first and second distances substantially uniform.

* * * * *